US005154358A

United States Patent [19]

Hartle

[11] Patent Number: 5,154,358

[45] Date of Patent: Oct. 13, 1992

[54] REPULSION DEVICE FOR LOW CAPACITANCE ELECTROSTATIC PAINTING SYSTEMS

[75] Inventor: Ron Hartle, Amherst, Ohio

[73] Assignee: Nordson Corporation, Westlake, Ohio

[21] Appl. No.: 665,602

[22] Filed: Mar. 5, 1991

[51] Int. Cl.[5] ..... B05B 5/025

[52] U.S. Cl. ..... 239/697; 239/690

[58] Field of Search ..... 239/690, 691, 697, 698, 239/700, 703–708

[56] References Cited

U.S. PATENT DOCUMENTS

| | | | |
|---|---|---|---|
| 2,959,353 | 11/1960 | Croskey et al. . | |
| 3,051,394 | 8/1962 | Sedlacsik, Jr. . | |
| 3,279,429 | 10/1966 | Felici et al. . | |
| 3,408,985 | 11/1968 | Sedlacsik, Jr. . | |
| 3,550,852 | 12/1970 | Wallis | 239/696 |
| 4,011,991 | 3/1977 | Masuda . | |
| 4,470,550 | 9/1984 | Coffee | 239/697 |
| 4,872,616 | 10/1989 | Behr et al. | 239/706 |
| 4,887,770 | 12/1989 | Wacker et al. . | |
| 5,039,019 | 8/1991 | Weinstein et al. | 239/691 |

FOREIGN PATENT DOCUMENTS

| | | | |
|---|---|---|---|
| 88/10152 | 12/1988 | PCT Int'l Appl. | 239/691 |

*Primary Examiner*—Andres Kashnikow
*Assistant Examiner*—Karen B. Merritt
*Attorney, Agent, or Firm*—Wood, Herron & Evans

[57] ABSTRACT

An electrostatic repulsion device is provided in an electrostatic spray paint booth having a grounded ceiling and conveyor to improve transfer efficiency in applying the paint to a workpiece and maintain a safe working environment without requiring protective fencing between an operator and the application equipment. The device includes an electrical cable having a resistive conductor surrounded by an insulation layer. The conductor provides a low electrical capacitance when connected to a high voltage source. Conductive pins are mounted along the cable through the insulation to contact the conductor and are arranged parallel to the spray path in two longitudinal groups, with the first set being diametrically opposed to the second set. Each pin has a discharge end that is substantially flush with the outside surface of the insulation layer. The device is transversely mounted with respect to a spray path of charged, atomized paint particles dispensed from a non-conductive, rotary spray device, so that an electrostatic field from the first set of conductive pins repels the atomized, charged paint particles away from the grounded ceiling and conveyor of the paint booth towards a workpiece. The electrostatic field produced by the second set of conductive pins bleeds accumulated charge from the repulsion device before a high energy discharge can occur whenever a grounded object comes into proximity with the device. This safety feature eliminates the need for protective fencing and interlocks within the spray booth.

53 Claims, 3 Drawing Sheets

REPULSION DEVICE FOR LOW CAPACITANCE ELECTROSTATIC PAINTING SYSTEMS

FIELD OF THE INVENTION

This invention relates to electrostatic spray coating.

BACKGROUND OF THE INVENTION

Devices for electrostatically charging coating material that is atomized by a rotary atomizer or spray gun and sprayed towards a workpiece are generally known. Such coating devices typically include a conduit for bringing pressurized coating material within the device to a spray head or rotating cup to atomize the coating material. In the case of rotary atomizers, in the past the entire atomizer including the rotating cup have been constructed from metal and charged to a high voltage to charge the coating material as it is being atomized and sprayed from the edge of the spinning cup. The charged, atomized coating material particulate is dispensed forwardly towards a workpiece that is typically hung from a conveyor by a suspending member such as a hook or the like. The workpiece is typically connected through the hook and a conductive member associated with the conveyor to an electrical ground. The charged atomized coating is attracted to the electrically grounded workpiece to completely coat it due to electrostatic effect.

The spray heads or rotary cups which atomize the coating material, spray or throw the atomized coating in a tangential direction relative to the particulate flow path towards the workpiece producing a spray pattern that is larger than the workpiece to ensure that the surface of the workpiece is completely coated. Atomized particles which are not deposited onto the workpiece are called overspray. The greater the amount of overspray from the dispensing device the less the transfer efficiency of the coating material (i.e., the proportion of the paint sprayed which is actually applied to the workpiece).

Moreover, overspray will either fall by gravity to the floor, be carried by air currents to the overspray control system, or be attracted to other grounded objects in the vicinity of the overspray such as the booth ceiling, and conveyor. Where overspray is allowed to accumulate on conveyor hooks, the electrical grounding connection between the hooks and the workpieces can be reduced or lost in which case even more overspray is produced because the charged particles are no longer attracted to the workpieces.

This problem has been solved with the metal rotary atomizers of the prior art described above by including a metal rod, charged to the same potential as the atomizing cup, located above the rotary atomizer and below the ceiling to repel the charged particles away from the ceiling and conveyor and towards the workpiece. Since the entire rotary atomizer has in the past been a highly charged, sizeable piece of metal equipment, it has been necessary to enclose it in a protective fence with interlocks which cut power to the atomizer when any access doors in the fencing are opened to protect operators. The metal repulsion rods described above, normally equipped with a row of sharp pins projecting from them, have also been highly charged and sizeable pieces of metal equipment and so they also have been located within the protective fencing.

Recently, a low capacitance electrostatic rotary atomizer, constructed substantially entirely from non-metallic components, has been made commercially available which does not present shock hazards to operators, and consequently, has not required protective fencing or electrical interlocks. With this type of rotary atomizer, the placement of a metal repulsion rod above the atomizer to control overspray by repelling the paint particles towards the workpiece and away from the ceiling and conveyor, would create a safety hazard requiring protective fencing and interlocks which deprives the user of the advantage of having a low capacitance, safe rotary atomizer.

SUMMARY OF THE INVENTION

To solve the above-identified problem, the applicant has invented a low capacitance, safe repulsion rod which can be placed in the vicinity of a low capacitance rotary atomizer without presenting a safety hazard requiring protective fencing.

The applicant has also found the device constructed in accordance with the principles of the present invention to be useful with other low capacitance electrostatic coating devices such as resistive electrostatic spray guns for both powder and liquid coating applications. The device can be used with these spray guns to achieve advantages similar to those obtained with the low capacitance rotary atomizer although the invention is preferably used with a low capacitance rotary atomizer.

The device of the present invention is constructed from a length of electrical cable having an insulated covering and an electrical conductor therein. The cable is connected to a high voltage power cable through a connector having a conductive member therein which electrically connects the high voltage power cable to the conductor within the electrical cable. Concentrically mounted about the insulated covering of the electrical cable is an electrically insulative cover to provide further electrical insulation. The insulative cover has diametrically opposed holes at predetermined intervals along its length. Electrically conductive pins are mounted within the holes and through the insulation of the electrical cable so that they electrically connect with the conductor of the cable. The ends of the pins distal from the conductor are generally flush with the insulative cover. This assembly comprises the electrostatic repulsion device and the pins of the device are oriented so that a forward set of pins repel the atomized particles towards the workpiece while the pins within the rearward holes produce a fringing field that bleeds charge from the device as a grounded object is brought in proximity thereto, or as an operator approaches from behind, to prevent a rapid discharge from the device and the attendant ignition or shock hazards.

In a preferred embodiment of the invention, the length of the electrical cable is mounted through a bore or passage in the connector and the high voltage cable is connected to the cable conductor via a conductive member within the connector so that the high voltage cable is substantially perpendicular to the length of the electrical cable. The electrical cable segments extending from either side of the bore in the connector are approximately equal in length. A resistor is interposed between the conductive member and the high voltage cable to reduce the current therethrough and the associated ignition hazard.

In a second embodiment of the present invention a connector having the bore for mounting the electrical cable is again used to perpendicularly connect the high voltage cable to the cable segments. In this embodiment, however, the cable segments extending from the connector are joined together at their distal ends from the connector to form a circular repulsion device that can encircle the dispensing device in a concentric relationship with respect to the atomizing cup, or spray head. This structure provides a continuous electrostatic field which repels the charged atomized particles away from the atomizer or spray head and towards the workpiece.

Moreover, the further towards the workpiece the circular repulsion device is located, the smaller the spray pattern produced by the atomizer or spray head and vice versa. Thus, this embodiment of the repulsion device can be used to symmetrically collapse or expand the spray pattern produced by the atomizer or spray head.

The advantage provided with either embodiment whether it is used to repel the pattern away from the ceiling or conveyor, or to symmetrically collapse or expand the pattern, or even to shape the pattern in other ways, is to provide pattern shaping in a system employing a low capacitance rotary atomizer, or low capacitance (i.e., resistive) spray gun, without creating a safety hazard which would require fencing and interlocks to maintain operator safety.

This advantage and other objects and advantages of the present invention are apparent from the reading of the following description made in connection with the accompanying drawings.

BRIEF DESCRIPTION OF THE DRAWINGS

FIG. 5 is a cross-sectional detail view similar to FIG. 4A of an alternative embodiment.

DETAILED DESCRIPTION OF THE PREFERRED AND ALTERNATIVE EMBODIMENT

Figure 1:
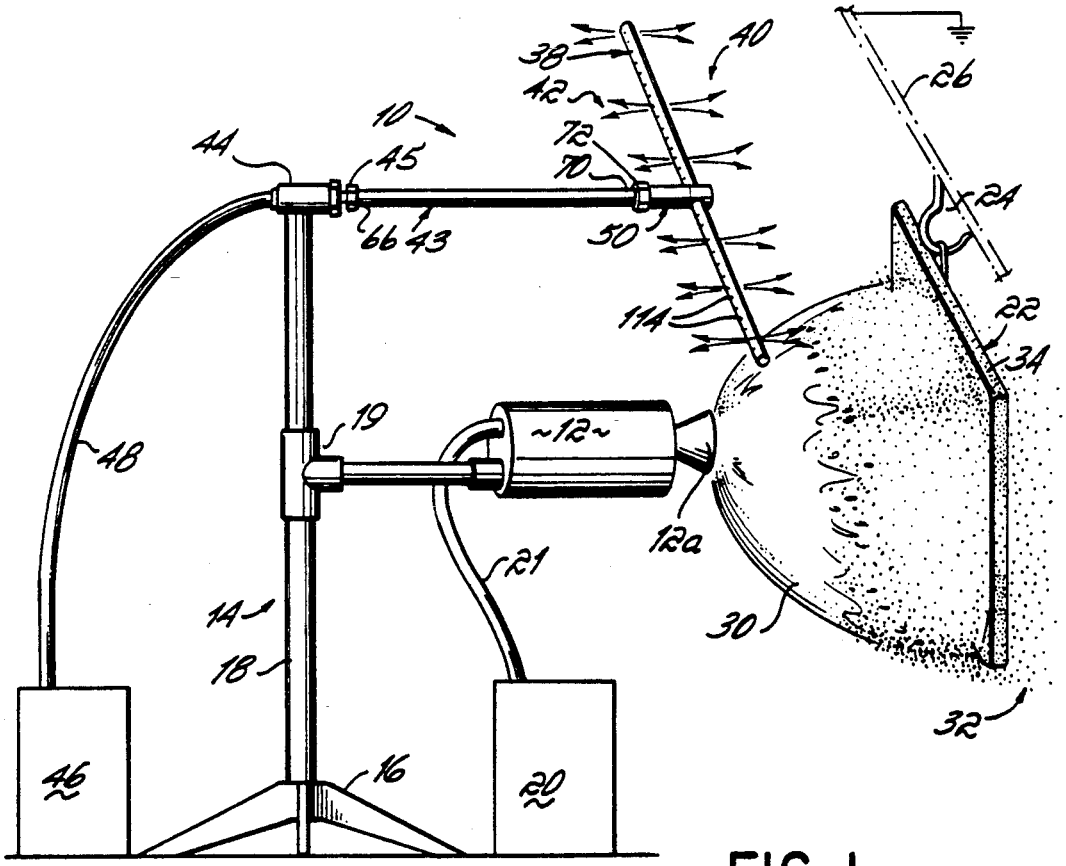
FIG. 1 is a perspective of a preferred embodiment of the invention used with an electrostatic charging, spray dispensing device to coat a workpiece.

An electrostatic repulsion device constructed according to the principles of the present invention is shown in use with a coating material dispensing device in FIG. 1. The repulsion device 10 and dispensing device 12 are shown mounted to a support stand 14. Support stand 14 has a base 16 and a vertical rod 18 that may telescope vertically above joint 19 to alter the distance between repulsion device 10 and dispensing device 12. Dispensing device 12 is shown connected to a high voltage supply 20 via a high voltage cable 21.

Dispensing device 12 is in the preferred embodiment, a low capacitance rotary atomizer as described in U.S. Pat. No. 4,887,770, which is hereby expressly incorporated by reference, and which is available from Nordson Corporation of Amherst, Ohio, as a Model RA 12 rotary atomizer. This rotary atomizer is constructed from non-metallic components, and has a unique charging system which is not a part of the present invention. The rotary atomizer has a low electrical capacitance so no protective fencing is required to protect the operator from electrical shocks, and thus, none is shown. While the invention will be described with respect to this rotary atomizer for simplicity, the invention is also applicable to low capacitance (i.e., resistive) powder or liquid electrostatic spray guns.

A conduit (not shown) brings coating material to device 12 and eventually to the interior of the rotating cup **12*a* to produce electrostatically charged atomized coating material which is sprayed from the forward end of device 12. The charged, atomized coating material sprayed from the cup 12*a* of device 12 is directed towards a workpiece 22 that is suspended by a member 24 such as a hook or the like from a conveyor 26. Conveyor 26 brings workpiece 22 near the cup 12*a* of device 12 to coat the workpiece 22. The spray pattern 30 shown in FIG. 1 includes an overspray portion 32. Workpiece 22 is electrically grounded through hook 24 and a conductive element (not shown) within conveyor 26. Workpiece 22 remains electrically grounded to electrically attract the charged atomized particles within spray pattern 30 as long as electrical continuity is maintained between the hook 24 and workpiece 22**.

To prevent overspray 32 from being attracted to and coating the ceiling (not shown), conveyor 26 and especially hook 24, which would deteriorate the ground connection to workpiece 22, the low capacitance electrostatic repulsion device 10 is used as shown in FIG. 1. This device includes a repulsion rod or member 38 transversely oriented to the flow of spray 30 which emits an electrostatic field 40 forwardly of rod 38. This forward electrostatic field 40 is at the same electrostatic potential as the particulate within spray pattern 30 and consequently repels the particulate downwardly from the repulsion rod and the electrically grounded ceiling and conveyor 26 towards workpiece 22. Electrostatic field 40 causes that portion of overspray 32 which would otherwise be available to coat hook 24 to drop close enough to workpiece 22 to be attracted to it instead. Thus, the transfer efficiency of the coating material dispensed by atomizer 12 to paint workpiece 22 is improved by electrostatic field 40. Moreover, as will later be disclosed in more detail, this advantage is produced without introducing a dangerously capacitively charged piece of equipment into the spray environment.

Repulsion rod 38 also provides an electrostatic field 42 which extends rearwardly to reduce the risk of an ignition or shock hazard to an operator approaching from the rear of the device. A grounded operator who moves into proximity to the rear of repulsion rod 38 contacts field 42 and bleeds the electrostatic charge from rod 38 to avoid a shock or a high energy spark which could ignite the volatile paint spray booth environment.

Electrostatic repulsion device 10 is connected to stand 14 by means of an extension 43 which is connected to joint 44, both of which have a passage therethrough. Extending from high voltage power supply 46 is a high voltage cable 48 which passes through joint 44 and retaining nut 45. Cable 48 has a contact (not shown) at its end which engages jumper 74 (FIG. 2A) within extension 43. As described in detail hereinafter, jumper 74 is electrically connected through a resistor 78 and a conductive member or pin 52 (FIG. 2B) to a conductor 98 (FIG. 2B) within repulsion rod 38 to supply electrostatic fields 40, 42 through conductive members which are mounted within holes in repulsion rod 38 as is described below.

Figure 2B:
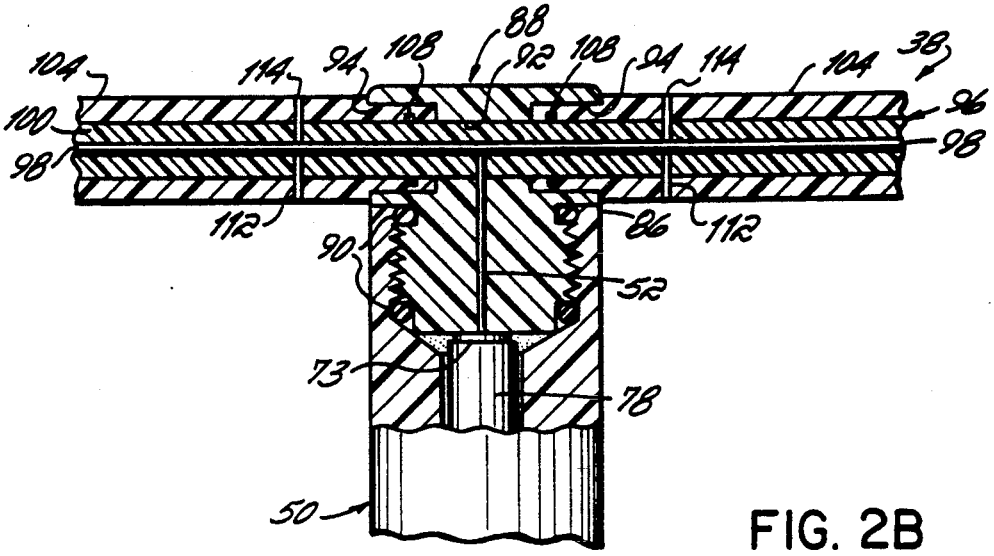
FIG. 2B is a cross-sectional view of the electrically repulsion device along the end of the connector.
Figure 2A:
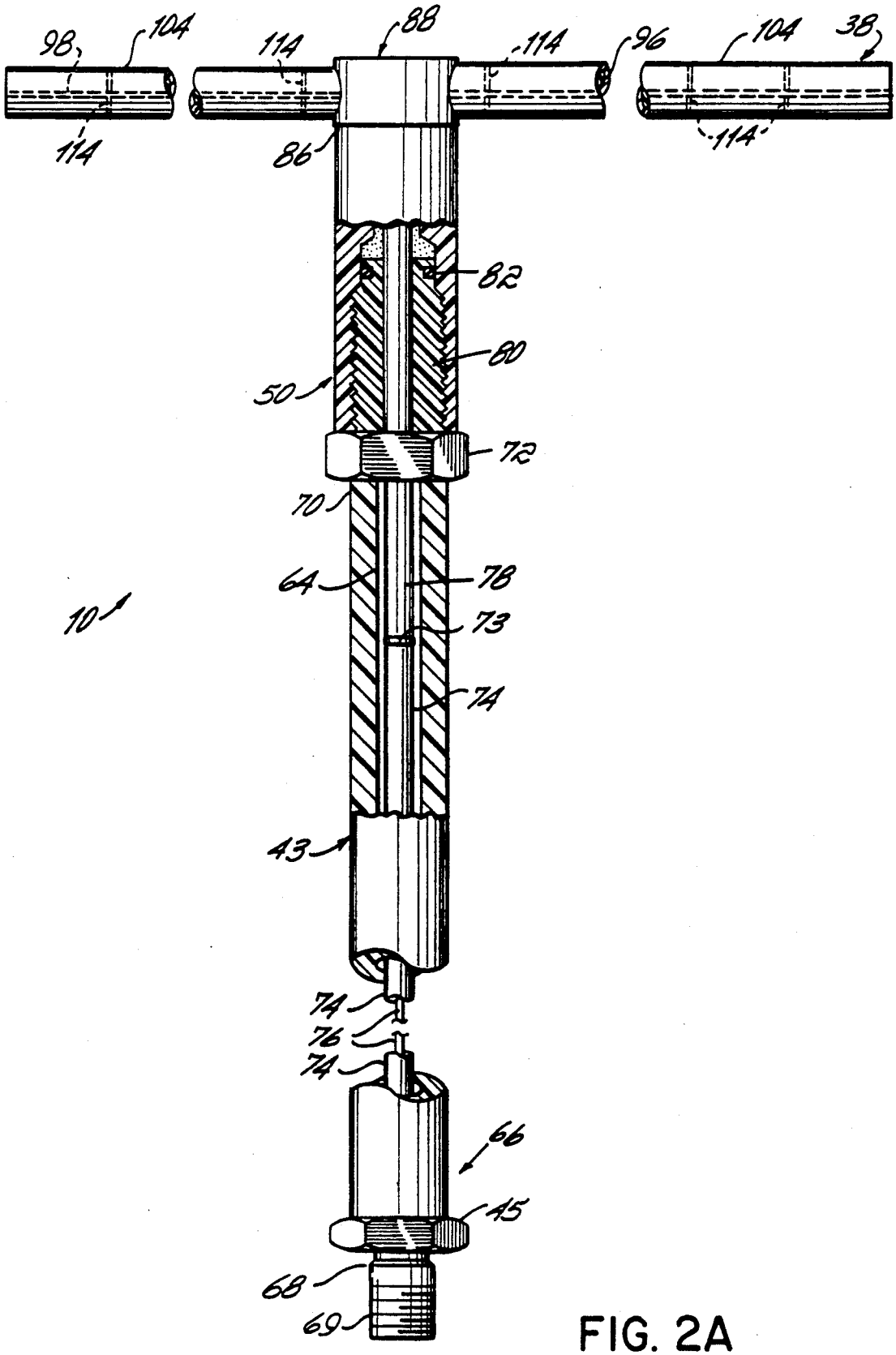
FIG. 2A is a cross-sectional and cut-away view of the extension and repulsion rod sections of the electrical repulsion device shown in FIG. 1.

The details of the connections between extension rod 43 and high voltage cable 48 are shown in FIG. 2A. Extension 43 is preferably a cylinder constructed of non-deformable material such as nylon stock or the like having a longitudinal passage 64 therethrough. At lower end 66, extension 43 is tap drilled to receive threaded adaptor 68. Threaded end 69 of adapter 68 receives high voltage electrical cable 48 and retaining nut 45 is tightened about end 69 to abut the contact on the end of cable 48 to a like contact on the end of jumper 74 to electrically connect them within extension 43. Jumper 74 is installed within central passage 64 and has a washer and pin contact 73 on its top end in FIG. 2A which is identical to the contact and pin of the opposite end. A conductor 76 within jumper 74 connects the pin contacts at each end to give electrical continuity through the length of jumper 74. End 70 of extension 43 has a jam nut 72 threaded thereon and a telescoping male extension 80 which is received within connector 50. Mounted through jam nut 72 at end 70 is a resistor 78 which contacts the washer and pin contact 73 of jumper 74 at one end and extends beyond the telescoping end 80 of extension 43 within connector 50 at the other end. An O-ring seal 82 is provided at the uppermost portion of end 80.

Resistor 78 is well known within the art and in the preferred embodiment is a 275 megohm resistor with a power rating of 5 watts. Jumper 74 is deliberately oversized in length so that when device 10 is assembled, as described in detail below, conductive member 52 (FIG. 2B), resistor 78, jumper 74, and the end of cable 48 are mechanically compressed together to ensure good electrical contact.

The details of the connection between repulsion rod 38 and connector 50 are shown in FIG. 2B. Mounted at end 86 of connector 50 is a cap 88 which is securely held within connector 50 by threads which are sealed by O-rings 90. Cap 88 has a bore or passage 92 therethrough with openings 94 at opposed ends, which are all transversely oriented with respect to extension 43 and connector 50. A length of electrical cable 96, having an electrical conductor 98 surrounded by insulation layer 100, is mounted with passage 92 so that repulsion rod 38 is divided into two equal length segments extending from opposite sides of connector 50. Conductive member or pin 52 mounted within cap 88 engages resistor 78 at one end and conductor 98 at its other end to establish electrical continuity from the high voltage cable 48 through jumper 74 and resistor 78 to conductor 98. Cable 96 as well as cable 48 and jumper 74 are preferably fabricated as the one disclosed in U.S. Pat. No. 4,576,827 assigned to the assignee of the present application. The contents of U.S. Pat. No. 4,576,827 to Hastings which issued on Mar. 18, 1986 are hereby explicitly incorporated by reference.

The cable disclosed in the U.S. Pat. No. 4,576,827 has a continuous resistive core so that at any point along its length the rate and amount of any capacitive discharge is limited. This type of cable is particularly advantageously used with the present invention as will become apparent.

Secured within openings 94 of cap 88 and mounted about the cable segments extending from the opposite sides of connector 50 are protective and electrically insulating tubes or sheaths 104. These tubes are primarily constructed from a material having a very low electrical capacitance so little charge accumulates on their outside surface even when present in electrostatic fields 40 and 42. Such sheaths are well known within the art. In the preferred embodiment, this sheath is constructed from a phenolic resin and has a NEMA G-10 rating. The sheath of the preferred embodiment permits its cleaning with solvent without degrading its electrical or structural characteristics. Protective tubes 104 are epoxied to cap 88 by filling grooves 108 with an epoxy glue prior to their insertion into openings 94.

Pairs of diametrically opposed holes 112, as shown in FIG. 2B, are provided along the longitudinal length of tubes 104. Within these holes there are mounted conductive members or pins 114. Each conductive member 114 is inserted in hole 112 and through insulative layer 100 until one end electrically contacts conductor 98. Where the cable of the U.S. Pat. No. 4,576,827 patent is used, conductor 98 is a bundle of continuous silicon carbide fibers which conduct the charge to the spray device but also have a resistivity which limits the rate of capacitive discharge. The other end of conductive members 114 are cut flush with the outer surface of tube 104 to eliminate discharge ends beyond the surface of the tube 104 for electrostatic fields 40, 42. In the preferred embodiment of the invention, holes 112 are approximately 0.030–0.035 inches long and have a diameter of approximately 0.030 inches, though the practice of the present invention is not limited thereto. Holes 112 are separated by a distance to maintain the edge of electrostatic field 42 at a location where a grounded object begins to bleed charge from the surface of tube 104 without creating an ignition hazard. In the preferred embodiment of the invention, the cable of the U.S. Pat. No. 4,576,827 is used for the cable length in repulsion rod 38 as well as for jumper 74 and cable 48 which is preferably connected to a Nordson Corporation Model EPU9 Power Supply, and the distance between holes 112 is approximately 2 inches and each sheath 104 has 16 pairs of the diametrically opposed holes separated by this preferred distance.

Figure 3:
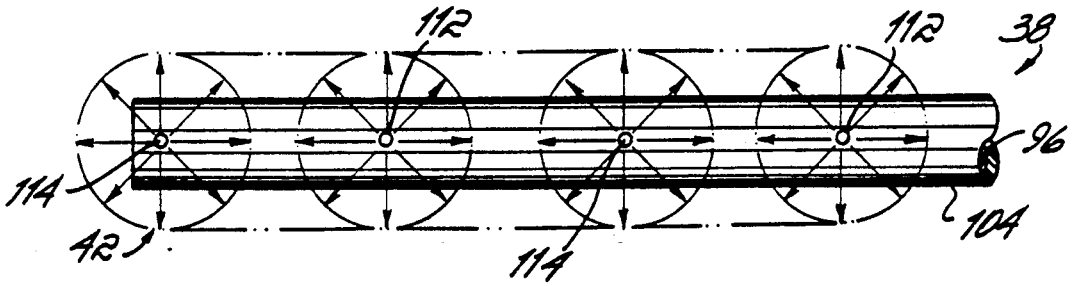
FIG. 3 is a schematic drawing of an electrostatic field produced along the surface of the repulsion rod.

FIG. 3 shows a row of holes 112 within tube 104 to illustrate the electrostatic fields produced by conductive members 114 mounted therein. The phantom lines shown in FIG. 3 represent equipotential lines of the electrostatic field emanating from pins 114 that extend from the surface of tube 104. Additionally, these field lines extend out of the plane of the diagram and represent the repulsive force that directs the particulate in overspray 32 towards workpiece 22. Adjacent holes arranged in the row are separated by a distance that prevents the equipotential lines extending from a discharge end from terminating on the surface of tube 104 at a point between adjacent holes. This permits the electrostatic field to present equipotential lines at a substantially constant distance from tube 104 so the field does not have gaps. Thus, a grounded object cannot be moved into the electrostatic field without crossing an equipotential line that represents an electrical potential great enough to bleed charge from rod 38 to the grounded object without a high energy discharge.

Electrostatic field 40 improves the transfer efficiency of spray 30 onto workpiece 22 in two ways. First, the like charge of field 40 and the atomized particles within spray pattern 30 repels the particles downwardly toward workpiece 22. Second, since more of the particles are directed to workpiece 22 and away from hook 24, workpiece 22 remains in good electrical contact with the electrically grounded conveyor 26 to attract the charged particles and improve transfer efficiency. This improvement in transfer efficiency is moreover obtained while maintaining the safe painting environment provided by a low capacitance rotary atomizer. In the preferred embodiment of the invention, and for many applications, these effects are maximized when repulsion rod 38 is even with or up to approximately 2 inches behind, the discharge end of rotary atomizer cup 12*a* of device 12 and approximately 18 to 24 inches above device 12.

In a similar fashion, an electrostatic field having the same configuration and orientation about tube 104 is provided along the rearward surface of tube 104 by conductive members 114 which are mounted within holes 112 diametrically opposed to the holes 112 along the forward edge. When an operator or grounded object moves into contact with electrostatic field 42, the capacitance available for discharge immediately begins to migrate to the operator or grounded object through a low energy, safe discharge since the surface of tube 104 and the associated cable and conductive pins have a very low electrical capacitance.

As mentioned above, the cable preferably used in repulsion rod 38 has a resistive core. This means that the core of the cable which is conducting the electrical charge to the pins 114 is not adding appreciably to the capacitance which is available for discharge. Moreover, there is very limited capacitance available for discharge in the electric circuit between the rod 38 and the power supply 46 due to the use of a resistive cable for cable 48 and jumper 74, as well as the placement of resistor 78 just before the rod 38. Thus, the conductive mass of the pins 114 themselves possibly provide the largest capacitance available for immediate discharge to an operator or grounded object. By providing these pins 114 in opposed pairs diametrically opposite one another, it is not possible to "sneak up" on a pin from behind to draw a sudden and substantially complete discharge of all available capacitance since the rearward pin will tend to discharge the capacitance of its associated forward pin as it is being slowly discharged from an approaching operator or object.

Figure 4:
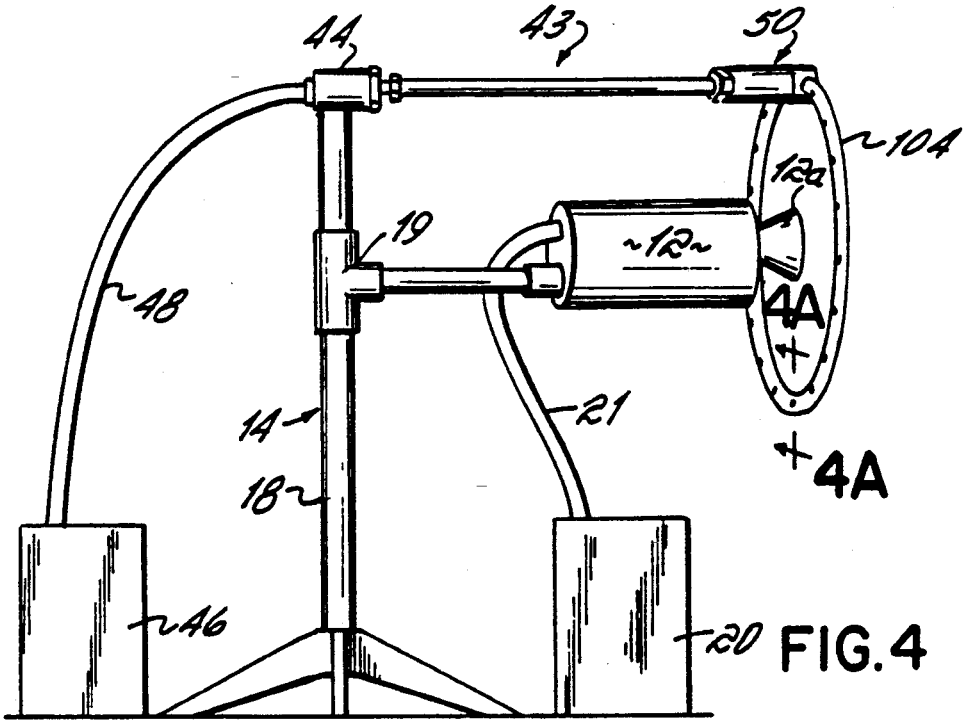
FIG. 4 is a perspective of an alternative embodiment of the present invention.
Figure 4A:
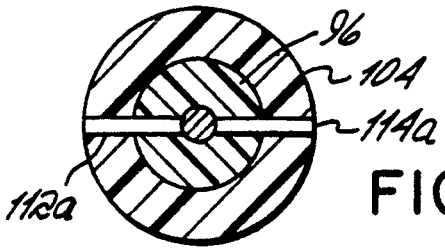
FIG. 4A is a cross-sectional detail view taken along lines 4A—4A shown in FIG. 4.

An alternative embodiment of the present invention is shown in FIG. 4. In this embodiment, tube 104 has been fabricated in a circular configuration with cable 96 mounted therein to form a charged closed loop or perimeter for generating a forward electrostatic field about spray 30. Dispensing device 12 is concentrically mounted within the area surrounded by tube 104 to focus spray 30 towards work surface 22. As with the previous embodiment, as shown in Detail 4A, tube 104 includes pins 114*a* mounted within diametrically opposed holes 112*a* which serve the same purpose as described above. With this embodiment, as the tube 104 is moved along atomizer 12 towards the forward discharge edge of cup 12*a*, the field produced by forward pins 114*a* repels the atomized particles of the conical or bell-shaped spray pattern more strongly towards the workpiece being painted, with the result that forward movement of tube 104 symmetrically collapses or closes down the diameter of the spray pattern. Conversely moving the tube 104 rearwardly along atomizer 12 allows the pattern to open up towards the normal size it would assume due to the centrifugal forces of cup 12*a*. Thus, to prevent, overspray from coating the conveyor hooks 24, the tube 104 is moved forwardly enough to adequately collapse the spray pattern.

Likewise, tube 104 could be moved axially along the body of a fixed, or mounted, low capacitance electrostatic spray gun to produce the same effect.

In another embodiment, the invention is to vertically orient one or two electrostatic repulsion devices 10 about dispensing device 12 to create vertical planes to direct spray 30 towards workpiece 22. Alternatively, a pair of repulsion devices could be employed horizontally above and below the atomizer to repel overspray away from both the ceiling and the floor. The distances between dispensing device 12 and repulsion rods 38 of these differing embodiments could be varied to produce symmetrical or asymmetrical spray patterns towards workpiece 22.

In a preferred method of making electrostatic repulsion device 10, cable 96 is centered within passage 92 of connector cap 88 (FIG. 2B). Conductive member 52 is inserted through cap 88 to electrically contact conductor 98. Grooves 108 of protective sheath 104 are filled with epoxy and inserted into openings 94 to secure them about cable 96. Conductive members 114 are then inserted into holes 112 so they electrically engage conductor 98 and the electrical continuity is checked between each pin and member 52 with a multimeter as is well known within the art. Pins 114 are then cut flush with the surface of sheath 104. Cap 88 is threaded into connector 50 and the threads are sealed by O-rings 90. With reference to FIG. 2A, cable adaptor 66 is threaded onto the end of extension 43 opposite connector 50 and extension 43 is filled with dielectric grease as well as the end of connector 50. This dielectric grease is used to completely fill the cavities where the high voltage components are mounted to prevent a dielectric breakdown and its attendant spark if air were permitted in these cavities.

Jumper 74 is inserted into passage 64 within extension 43. Resistor 78 is then inserted into extension 43 to engage jumper 74 and jam nut 72 is threaded onto the upper end of extension 43. This end of extension 43 is threaded into connector 50 so resistor 78 electrically contacts conductive member 52 to complete the assembly of repulsion device 10. Adapter 68 is filled with dielectric grease for the securement of cable 48 to extension 43. The end portion of high voltage power cable 48 is inserted into extension 43 to electrically contact jumper 74 and is threadably secured to the threads 69 by a suitable threaded coupling (not shown) which is mounted a few inches from the end of cable 48. High voltage cable 48 may now be connected to a high voltage power supply to provide the electrostatic potential needed to create electrostatic fields 40, 42.

While the invention has been principally described in connection with a presently preferred embodiment wherein it is employed with a low capacitance rotary atomizer, and an alternative embodiment, those skilled in the art will recognize many modifications of structure, arrangements, portions, elements, materials, and components that can be made in the practice of this invention without departing from the principles thereof. As noted, the invention is also applicable to low capacitance electrostatic liquid and powder spray guns. In addition, for example, an electrical cable having an insulative layer whose surface has a low electrical capacitance and a conductor with a high enough resistance could be used without sheaths 104. Such is shown in FIG. 5 wherein the discharge end of a pin 114*a* is substantially flush with the outside diameter of the electrically insulative layer which forms part of cable 96. Other such modifications within the spirit of the invention will also be obvious to those skilled in the art, and thus, the invention is intended to be limited only by the scope of the appended claims.

What is claimed is:

1. An electrostatic spray coating system, comprising:

a low capacitance electrostatic spray device; and a low capacitance electrostatic repulsion device for directing charged atomized particles dispensed from said spray device towards a workpiece held at a different electrical potential than the potentials of said repulsion and spray devices for the deposition of the charged particles thereon, said repulsion device including a high voltage electrical cable having an electrical conductor surrounded by an electrically insulative material, one part of said high voltage cable being adapted to connect said electrical conductor to a high voltage electrical power source, and a plurality of electrically conductive members extending inwardly through said electrically insulative material to electrically contact one end thereof with said electrical conductor and extending outwardly through said electrically insulative material to a discharging end so that electrical power supplied by said high voltage power source is conducted to and by said plurality of electrically conductive members to said discharging ends to create an electrostatic field having a polarity which repels like charged particles dispensed from said spray device towards said workpiece.

2. The system of claim 1 further comprising:

an electrical insulative sheath being configured to snugly receive and surround said electrically insulative material, said sheath having a plurality of holes so that said electrically conductive members may be inserted through said holes into said electrically insulative material to engage said electrical conductor and extend outwardly through said sheath so that said discharge ends of said electrically conducting members repel said like charged particles.

3. The system of claim 2 wherein said discharge ends are substantially flush with the outside dimension of said insulative sheath.

4. The system of claim 2 wherein said electrical conductor surrounded by said insulative material and said insulative sheath and having said electrically conductive members extending therethrough comprise a repulsion member, and further comprising a connecting means for electrically connecting said electrical conductor of said repulsion member to said high voltage power source.

5. The system of claim 4 further comprising:

a resistor adapted to be received within said connecting means to electrically connect said electrical conductor of said repulsion member to said high voltage power source, and resistor reducing the rate of current flow into said repulsion member from said power source.

6. The system of claim 4 wherein said connecting means is connected to an intermediate portion of said repulsion member so that said repulsion member has a first and a second segment extending outwardly from said connecting means.

7. The system of claim 6 wherein said first and second segments of said repulsion member are substantially equal in length.

8. The system of claim 6 wherein said first and second segments are joined together to form a continuous repulsion member so that said electrostatic field for repelling charged particles toward the workpiece is continuous about said electrostatic spray device.

9. The system of claim 2 wherein said plurality of holes in said insulative sheath are a plurality of hole pairs, each hole in each of said hole pairs being substantially diametrically opposed to the other hole in said pair.

10. The system of claim 2 wherein each hole is separated from an adjacent hole by a distance along the length of said sheath to maintain an electrostatic field along the length of said sheath between said adjacent holes at a constant distance therefrom.

11. The system of claim 1 wherein said electrical conductor has appreciable resistance, but less resistance than said electrically insulative material, to limit the capacitance of said conductor available for discharge and to limit the rate at which such capacitance could be discharged to an approaching grounded object.

12. The system of claim 1 further comprising:

mounting means for mounting said repulsion device in a predetermined relationship to said electrostatic spray device so that charged particles intended for deposition on the workpiece are repelled by the electrostatic field produced by said repulsion device and directed towards said workpiece to reduce overspray.

13. The system of claim 1 wherein said electrical conductor includes a semi-conductive material.

14. The system of claim 13 wherein said semiconductive electrical conductor is essentially comprised of silicon carbide fibers.

15. The system of claim 1 wherein said discharge ends are substantially flush with the outside dimension of said electrically insulative material.

16. The system of claim 1 further comprising:

said electrical conductor surrounded by said insulative material having said electrically conductive members extending therethrough being an electrostatic repulsion member; and connecting means for electrically connecting said electrical conductor of said electrostatic repulsion member to said high voltage power source.

17. The system of claim 16 further comprising:

a resistor adapted to be received within said connecting means to electrically connect said electrical conductor of said electrostatic repulsion member to said high voltage power source to reduce the rate of current flow into said electrostatic repulsion member.

18. The system of claim 16 wherein said connecting means is connected to an intermediate portion of said electrostatic repulsion member so that said electrostatic repulsion member has a first and a second segment extending outwardly from said connecting means.

19. The system of claim 18, said first and second segments being joined together to form a continuous electrostatic repulsion member so that said electrostatic field for repelling charged particles towards the workpiece is continuous along about the electrostatic spray device.

20. The system of claim 18 wherein said first and second segments of said electrostatic repulsion member are substantially equal in length.

21. The system of claim 1 wherein said plurality of electrically conductive members are a plurality of electrically conductive member pairs, each electrically conductive member in each of said electrically conductive member pairs being substantially diametrically opposed to the other electrically conductive member in said pair.

22. The system of claim 21 wherein each electrically conductive member is separated from an adjacent electrically conductive member by a distance along the length of said electostatic repulsion device to maintain an electrostatic field along the length of said electrostatic repulsion device between said adjacent electrically conductive members at a constant distance therefrom.

23. A method for providing an electrical repulsion device for directing charged particulate dispensed from a low capacitance electrostatic spray device toward a workpiece held at an electrical potential different from that of he charged particulate dispensed from said electrostatic spray device, comprising:

adapting one part of an electrical cable having an electrical conductor therein surrounded by electrical insulative material for connection to an external high voltage power supply; and inserting a plurality of electrically conductive members through said insulative material to engage said electrical conductor and extend outwardly through said insulative material to a discharge end.

24. The method of claim 23 further comprising:

enclosing said insulative material within an electrically insulative sheath; and providing a longitudinal array of holes along the length of said sheath so said conductive members may be inserted through said holes in said sheath and said insulative material to electrically engage said electrical conductor and extend outwardly through said sheath to said discharge end to provide a continuous electrostatic field along the length of said insulative sheath when said adapted part is connected to a high voltage power supply.

25. The method of claim 24 further comprising:

terminating said conductive members extending from said sheaths so said discharge ends of said members are substantially flush with said sheath.

26. The method of claim 24 further comprising:

installing a connector to an intermediate portion of said electrical conductor to connect said intermediate portion to said high voltage power supply so that said electrical conductor has first and second segments extending outwardly from said connector.

27. The method of claim 26 further comprising:

connecting said connector to the approximate midpoint of the length of said electrical conductor so that said first and second segments are approximately equal in length.

28. The method of claim 26 further comprising:

inserting a resistor between said connector and said intermediate portion of said electrical conductor so that said resistor is in electrical connection between said electrical conductor and said high voltage supply.

29. The method of claim 26 further comprising:

joining the ends of said first and second segment to form a continuous electrical field for repelling said charged particles towards the workpiece.

30. The method of claim 29 further comprising joining the ends of said first and second segments to form a closed loop and positioning said closed loop concentrically with respect to said electrostatic spray device, and further comprising the step of moving said closed loop along said spray device to constrict the size of the spray pattern of atomized particulate dispensed from said spray device, and moving said closed loop along said spray device away from said spray device to allow said spray pattern to expand towards its normal size.

31. The method of claim 24 further comprising:

aligning said array of holes into a plurality of paired holes along the length of said sheath, each hole in each said pair being diametrically opposed to the other hole in said pair so that said electrically conductive members are inserted within each of said holes until said member engages said electrical conductor.

32. The method of claim 31 further comprising:

separating said holes that are adjacent in said array by a distance sufficient to maintain the electrostatic field produced by said electrically conductive members substantially continuous along the entire length of said insulative sheath.

33. The method of claim 32 further comprising:

constructing said electrical conductor from a material having appreciable electrical resistance, but less resistance than said electrically insulative material, to limit the capacitance of said conductor available for discharge and to limit the rate at which such capacitance could be discharged to an approaching grounded object.

34. A low electrical capacitance, electrostatic repulsion device for directing charged atomized particles dispensed from an electrostatic spray device towards a workpiece held at a different electrical potential for the deposition of the charged particles thereon, comprising:

a high voltage electrical cable having an electrical conductor surrounded by an electrically insulative material, one part of said high voltage conductor being adapted to connect said electrical conductor to a high voltage electrical power source; and a plurality of electrically conductive members extending inwardly through said electrically insulative material to electrically contact said electrical conductor and extending outwardly through said electrically insulative material to a discharge end so that electrical power supplied by said high voltage power source is conducted to and by said plurality of electrically conductive members to said discharge ends to create an electrostatic field having a polarity which repels like charged particles dispensed from the spray device towards the workpiece.

35. The device of claim 34 further comprising:

an electrical insulative sheath being configured to snugly receive and surround said electrically insulative material, said sheath having a plurality of holes so that said electrically conductive members may be inserted through said holes into said electrical insulative material to engage said electrical conductor within said cable and extend outwardly through said sheath so that said discharge ends of said electrically conductive members repel said like charged particles.

36. The device of claim 35 wherein said discharge ends are substantially flush with the outside dimension of said insulative sheath.

37. The device of claim 35 wherein said electrical conductor surrounded by said insulative material and said insulative sheath having said electrically conductive members extending therethrough comprise a repulsion member, and further comprising a connecting means for electrically connecting said electrical conductor of said repulsion member to said high voltage power source.

38. The device of claim 32 further comprising:

a resistor adapted to be received within said connecting means to electrically connect said electrical conductor of said repulsion member to said high voltage power source, said resistor reducing the rate of current flow into said repulsion member from said power source.

39. The device of claim 37 wherein said connecting means is connected to intermediate portion of said repulsion member so that said repulsion member has a first and a second segment extending outwardly from said connecting means.

40. The device of claim 39 wherein said first and second segments of said repulsion member are substantially equal in length.

41. The device of claim 39 wherein said first and second segments are joined together to from a continuous repulsion member so that said electrostatic field for repelling charged particles towards the workpiece is continuous about said electrostatic spray device.

42. The device of claim 35 wherein said plurality of holes in said insulative sheath are a plurality of hole pairs, each hole in each of said hole pairs being substantially diametrically opposed to the other hole in said pair.

43. The device of claim 35 wherein each hole is separated from an adjacent hole by a distance along the length of said sheath to maintain an electrostatic field along the length of said sheath between said adjacent holes at a constant distance therefrom.

44. The device of claim 34 wherein said electrical conductor has appreciable resistance, but less resistance than said electrically insulative material, to limit the capacitance of said conductor available for discharge and to limit the rate at which such capacitance should be discharged to an approaching grounded object.

45. The device of claim 34 further comprising:

mounting means for mounting said repulsion device in a predetermined relationship to said spray device so that charged particles intended for deposition on the workpiece are repelled by the electrostatic field produced by said repulsion device and directed towards said workpiece to reduce overspray.

46. The device of claim 34 wherein said electrical conductor includes a semi-conductive material.

47. The device of claim 46 wherein said semiconductive electrical conductor is essentially comprised of silicon carbide fibers.

48. An electrostatic repulsion device for repelling charged atomized particles comprising:

an electrical cable having first and second opposed ends, said cable having an electrical conductor extending from said first end to said second end with a high electrical resistance to limit current carried by said conductor, said conductor being surrounded by an electrically insulative material having an outer surface and a low electrical capacitance;

a pair of diametrically opposed conductive members having first and second ends, said first ends of said members electrically contacting said conductor and said second ends of said members being substantially flush with said outer surface of said insulative material; and a connector having an internal electrical connecting pin, said connector having a first end that is mounted about said cable so that one end of said electrical connecting pin electrically contacts said conductor within said cable and a second end that is adapted for electrically connecting the other end of said electrical connecting pin to a high voltage power supply cable whereby high voltage electrical power may be supplied to said conductor in said cable through said connecting pin in said connector to generate an electrostatic field about said cable from the electrical power delivered from said conductor to said second ends of said conductive members, said electrostatic field being used to repel like-charged particles in proximity of the electrostatic repulsion device and said electrostatic field not presenting a shock or ignition hazard since the high resistance of said conductor limits the current delivered to a grounded object within said electrostatic field and the lower capacitance of said insulative material reduces the amount of accumulated charge available for discharge to the grounded object.

49. The device of claim 48 wherein said connector is mounted to said cable approximately midway between said first and second ends of said cable to form first and second cable segments about said connector; and each of said first and second cable segments having at least one pair of diametrically opposed conductive members to generate the electrostatic field for repelling charged particles and reducing electrical discharge to a grounded object in the electrostatic field whenever high voltage electrical power is applied to said electrical connecting pin in said connector.

50. The device of claim 49 further comprising:

a plurality of pairs of diametrically opposed conductive members along each of said first and second cable segments, each one of said pairs being separated from an adjacent pair by a distance that permits electrostatic field lines emanating from said second ends of said conductor to substantially form equipotential lines at a constant distance from said cable so that said repelling and safe discharge area of the electrostatic field are consistently maintained about said cable.

51. The device of claim 50 wherein said distance separating adjacent pairs of diametrically opposed conductive members is approximately 2".

52. A method for electrostatically spraying charged coating particles onto a workpiece in a reduced electrical hazard environment comprising:

producing a spray of electrostatically charged coating particles with a non-conductive spray device, said spray being directed towards the workpiece;

generating an electrostatic field with a pair of diametrically opposed conductive members which extend from the conductor of an insulated cable having a low electrical capacitance, insulative layer surrounding the conductor; and aligning the pair of diametrically opposed conductive members with the direction of the spray to repel the charged coating particles towards the workpiece and to discharge accumulated charge from the insulated electrical cable with reduced risk of shock or ignition hazard whenever a grounded object is brought within the electrostatic field.

53. The method of claim 52 further including:

providing a plurality of diametrically opposed conductor members which extend from the conductor within the electrical cable; and spacing the plurality of diametrically opposed conductive members which are aligned with the direction of the spray along the electrical cable, to provide spaces between adjacent members which permit electrostatic field lines emanating from the conductive members to form equipotential lines at a constant distance from said cable.

* * * * *